United States Patent [19]

Tobe

[11] 4,235,084

[45] Nov. 25, 1980

[54] AUTOMATIC CONTROL SYSTEM FOR FLAT KNITTING MACHINE

[75] Inventor: Hideharu Tobe, Tokyo, Japan

[73] Assignee: Heiko Seisakusho, Ltd., Tokyo, Japan

[21] Appl. No.: 19,259

[22] Filed: Mar. 9, 1979

[51] Int. Cl.[3] ..... D04B 15/48

[52] U.S. Cl. ..... 66/232; 66/75.2

[58] Field of Search ..... 66/75.2, 231, 232; 340/172.5; 235/151.1

[56] References Cited

U.S. PATENT DOCUMENTS

| | | | |
|---|---|---|---|
| 4,006,611 | 2/1977 | Kahan et al. | 66/75.2 |
| 4,036,035 | 7/1977 | Kahan et al. | 66/75.2 |
| 4,040,277 | 8/1977 | Kahan et al. | 66/75.2 |
| 4,085,597 | 4/1978 | Kamikura et al. | 66/75.2 |
| 4,100,768 | 7/1978 | Kamikura et al. | 66/75.2 |

FOREIGN PATENT DOCUMENTS

| | | | |
|---|---|---|---|
| 2361746 | 6/1974 | Fed. Rep. of Germany | 66/75.2 |

*Primary Examiner*—Ronald Feldbaum

*Attorney, Agent, or Firm*—Whittemore, Hulbert & Belknap

[57] ABSTRACT

The present invention relates to a photoelectric reading type control system for a flat knitting machine, in which a single program sheet having marks at predetermined positions is verified by a photoelectric mark reader and selection of needles, change of threads and other operation are performed according to information verified by the mark reader.

In the present invention electromagnets disposed on a groove of the same pitch as that of a needle groove are independently actuated so that a selector is moved and a batt of a jack necessary for needle selection is shifted in the vertical direction with respect to a wing cam, thereby to enable optional selection of needles, and an automatic control system, especially a photoelectric reading type control system, is disposed so that selection of the jack and other operations are performed according to information obtained by verification of a single program sheet having marks at predetermined positions by a photoelectric mark reader.

7 Claims, 11 Drawing Figures

AUTOMATIC CONTROL SYSTEM FOR FLAT KNITTING MACHINE

BACKGROUND OF THE INVENTION

In conventional jacquard knitting machines, steel pattern plates are used to select needles one by one. According to this conventional needle selecting method, a long time is required for assembling of pattern plates and the expenses for formation of pattern plates are enormous.

Further, there has been adopted a method in which marks are formed by punching or the like on an endles sheet made by connecting a plurality of unit sheets to one another and these marks are verified, but in this method, there is a fear that an erroneous signal may be emitted from joints portions between two adjacent unit sheets constituting the endless sheet, and this method is defective in that registration of marks in such endless sheet is very troublesome.

SUMMARY OF THE INVENTION

The present invention relates to an automatic control system for a flat knitting machine. More particularly, the invention relates to a photoelectric reading type control system for a flat knitting machine.

It is primary object of the present invention to provide an apparatus in which the foregoing defects involved in the conventional techniques have been eliminated.

According to the apparatus of the present invention, a single program sheet which is not endless is used, marks formed on predetermined columns of the program sheet are verified by a mark reader, original point mark and return mark are formed at initial and terminal points of the program sheet, respectively, the program sheet is moved reciprocatively between positions corresponding to the initial and terminal points of the program sheet, and marks attached to the program sheet are photoelectrically detected in the reading zone. Therefore, the program sheet has no joint portion, and emission of an erroneous signal can be completely prevented.

Furthermore, according to the apparatus of the present invention, selection of jacks can be performed only by actuating inner and outer electromagnets and jacquard pattern plates such as used in the conventional machine need not be used at all, and selection of needles can optionally be accomplished very easily in a short time only by supply of electric signals.

Still further, even when it is required to store data on the program sheet, this can be accomplished only by forming marks at necessary points on the program sheet, and this operation can be performed much more easily than in the case of the conventional jacquard knitting machine using steel pattern plates.

DETAILED DESCRIPTION OF PREFERRED EMBODIMENT:

The present invention will now be described in detail by reference to embodiments illustrated in the accompanying drawing.

FIGS. 1 to 4 illustrate the knitting zone including a carriage and a needle bed in the apparatus of the present invention.

Figure 1:
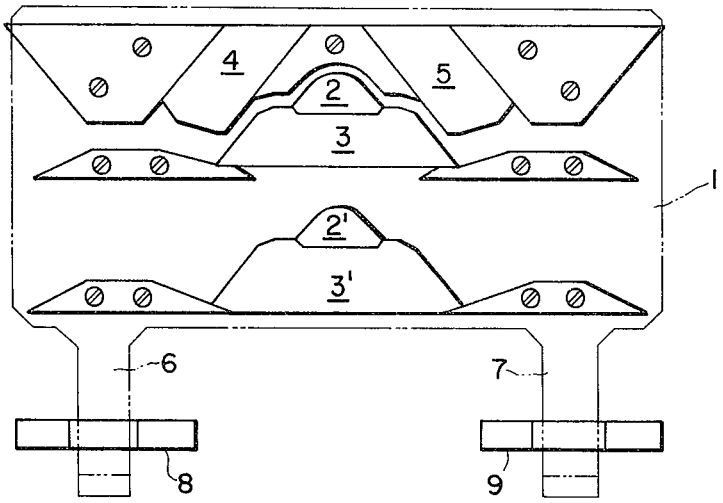
FIG. 1 is a perspective view, seen from above, of a cam portion mounted on a carriage.

Rererring to FIG. 1, middle cam 2, wing cam 3 and knitting cams 4 and 5 for operating needles and middle cam 2′ and wing cam 3′ for operating jacks are mounted on a base plate 1. Arms 6 and 7 are projected outwardly below the base plate 1, and jack operating cams 8 and 9 are disposed on the top ends of the arms 6 and 7, respectively. The jack operating cams 8 and 9 are fixed to the arms 6 and 7 elongated from the base plate 1 together with a cam attachment 11 fixed by a screw 12.

Needles 14 and jacks 15 are contained in a groove portion of a needle bed 13, and the lower part of the center of the needle bed 13 is notched to the groove portion, and a comb-like plate spring 19 is fixed to the notched part by a screw 20 so that one end of the plate spring 19 pushes up the respective jacks. Bands 16, 17 and 18 are disposed to press the upper portions of the needles 14 and jacks 15.

An electromagnet supporting plate 21 composed of a non-magnetic material and having a groove of the same pitch as that of the needle groove is fixed to the lower part of the needle bed 13 on the right end thereof through a dovetail groove, and an inner electromagnet 24 and an outer electromagnet 25 are contained in the groove of the supporting plate 21. A lower selector 26 is disposed between the two electromagnets so that the lower selector 26 is allowed to move to the left and right by small distances.

A selector receiver 29 composed of a non-magnetic material is disposed to press the inner and outer electromagnets 24 and 25 and to receive the lower selector 26 from below.

An upper selector 22 is disposed to operate the respective jacks 15 in such a manner that a longitudinal groove of the same pitch as that of the needle groove, which is formed in the upper portion of the selector 22 on the right end of the needle bed 13, acts as one guide and a press plate 23 on the right end of the needle bed 13 acts as another guide. The lower end of the selector 22 is located on the top face of the lower selector 26, and the top end of a comb-like plate spring 27 is fitted in the central groove of the upper selector 22 to push up the upper selector 22.

Figure 3:
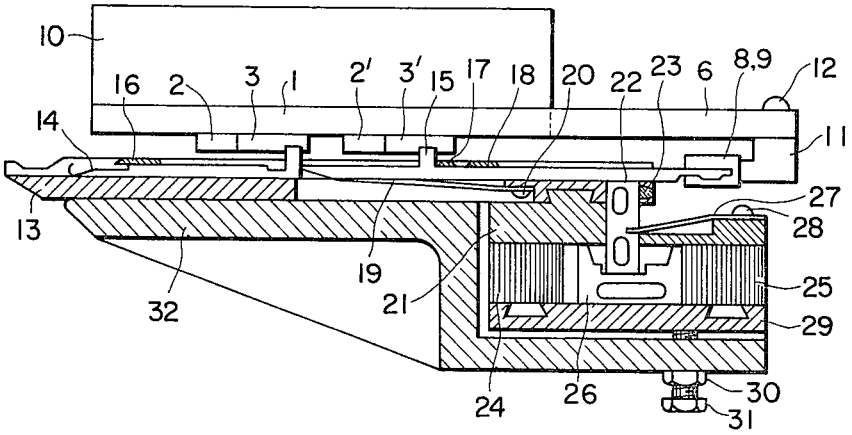
FIGS. 3, 4 and 5 are longitudinally sectional side views of a needle bed illustrating the operation states.

The plate spring 19 for pushing up the jacks 15 has a higher strength than the plate spring 27 for pushing up the upper selector 22, and therefore, the jacks 15 are held in parallel to the needle bed 13 as shown in FIG. 3. The above-mentioned needle bed 13, electromagnet supporting plate 21 and selector receiver 29 are integrally fixed to a needle bed frame 32, and the right ends of these members are received by a bolt 31 which is fixed by a nut 30.

Figure 6:
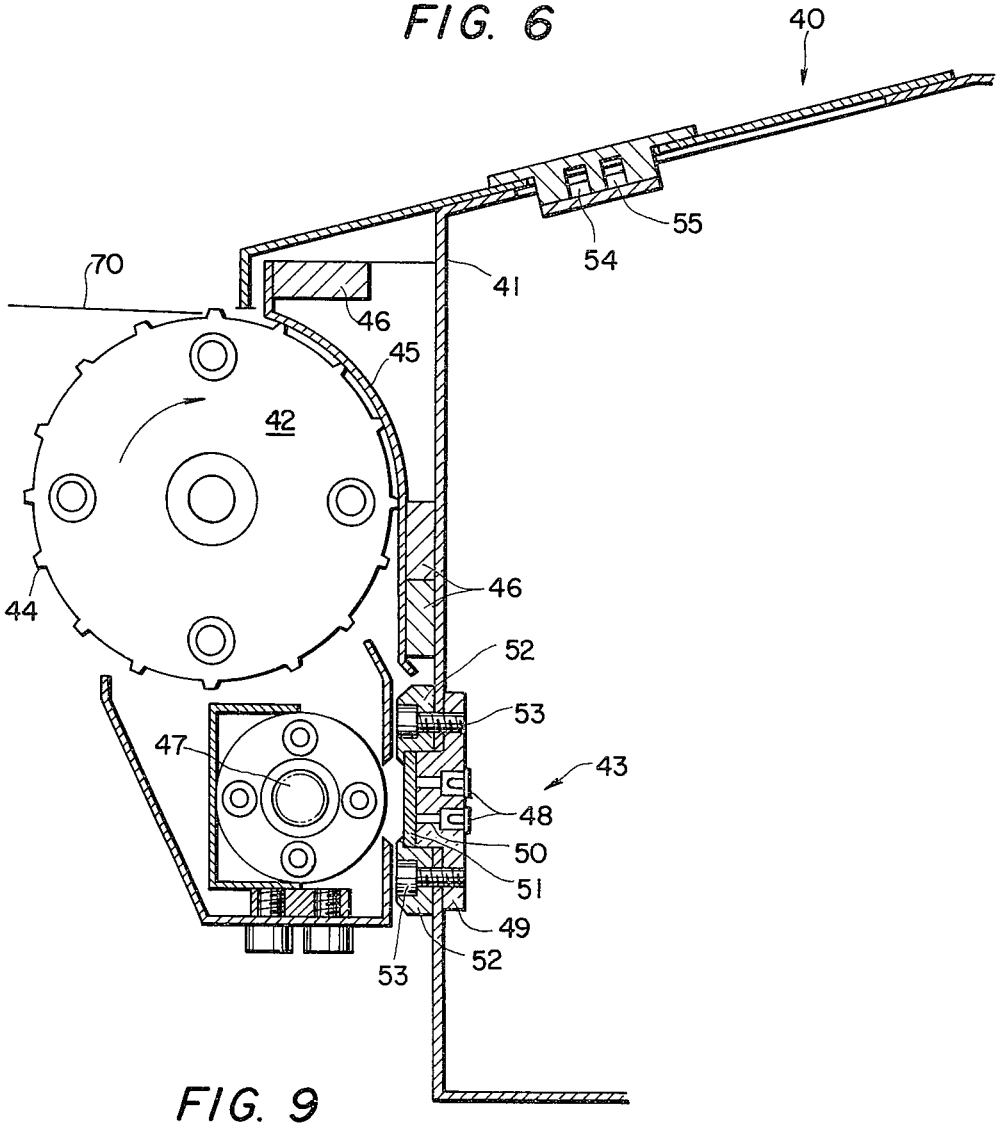
FIG. 6 is a view showing the longitudinal section of a mark reader.
Figure 7:
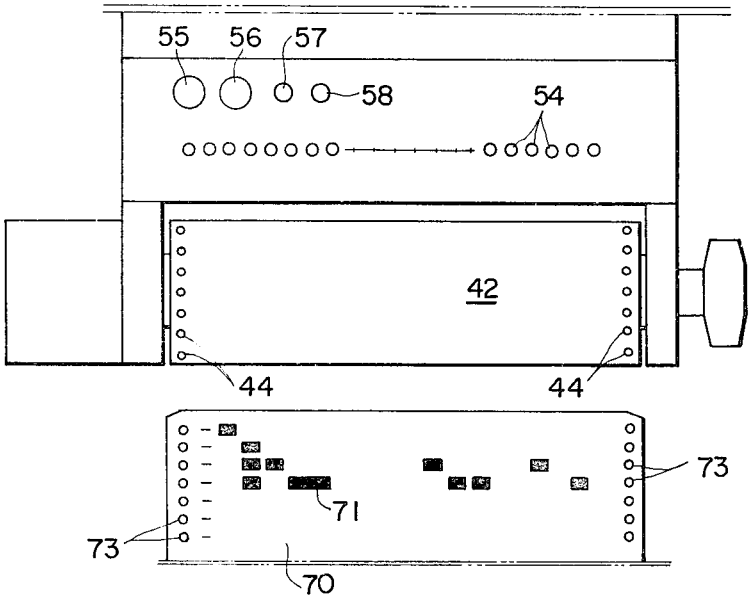
FIG. 7 is a plan view showing diagrammatically the structure of the mark reader.

A mark reader used in the apparatus of the present invention is illustrated in FIG. 6. The mark reader 40 is means for reading out marks 71 on a program sheet 70 shown in FIG. 7 and converting information of the program sheet to an electric signal, and the mark reader 40 comprises an electric equipment box 41, a feed drum 42 and a reading zone 43. The feed drum 42 is rotatably mounted on the front face of the electric equipment box 41 and is rotated in the clockwise direction in FIG. 6 by means of a motor (not shown). Sprockets 44 are arranged at equal pitches on both the side edges of the feed drum 42, and by engagement of perforations 73 on both the side edges of a program sheet 70 with these sprockets 44, the program sheet 70 are fed with rotation of the feed drum 42. A sheet guide 45 covering the periphery of the feed drum 42 is fixed to the electric equipment box 1 through a stay 46.

The reading zone 43 is disposed on the read-out side of the feed drum 42, and this reading zone 43 includes a light emission tube 47 and phototransistors 48 disposed as the light receiving member corresponding to the light emission tube 47. The photoresistors 48 corresponding to the light emission tube 47 are contained in a plurality of small holes 50 formed on a phototransistor receiver 49. All the small holes 50 are directed to the light emission tube 47 so that rays from the light emission tube 47 pass through these small holes 50 and arrive at the photoresistors 48. Reference numeral 51 represents a covering glass sheet. The phototransistor receiver 49 is fixed to the electric equipment box 41 together with a glass sheet press 52 by means of a screw 53. In the embodiment illustrated in the drawing, the small holes 50 of the phototransistor receiver 49 are arranged in one line so that they correspond to the regions of the program sheet 70 in which marks 71 are formed, and these holes may be arranged in two lines or more appropriately according to the arrangement of the marks on the program sheet 70. The interval between every two adjacent small holes 50 should be the same as the interval between every two adjacent regions to be marked in the program sheet 70.

Reference numerals 54, 55, 56, 57 and 58 represent an instruction display lamp, an interlocking switch, a power source switch, a saving break switch and an original point return switch, respectively.

Figure 9:
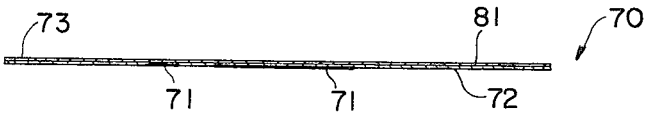
FIG. 9 is a view showing the section taken along the line IX—IX in FIG. 8.
Figure 8:
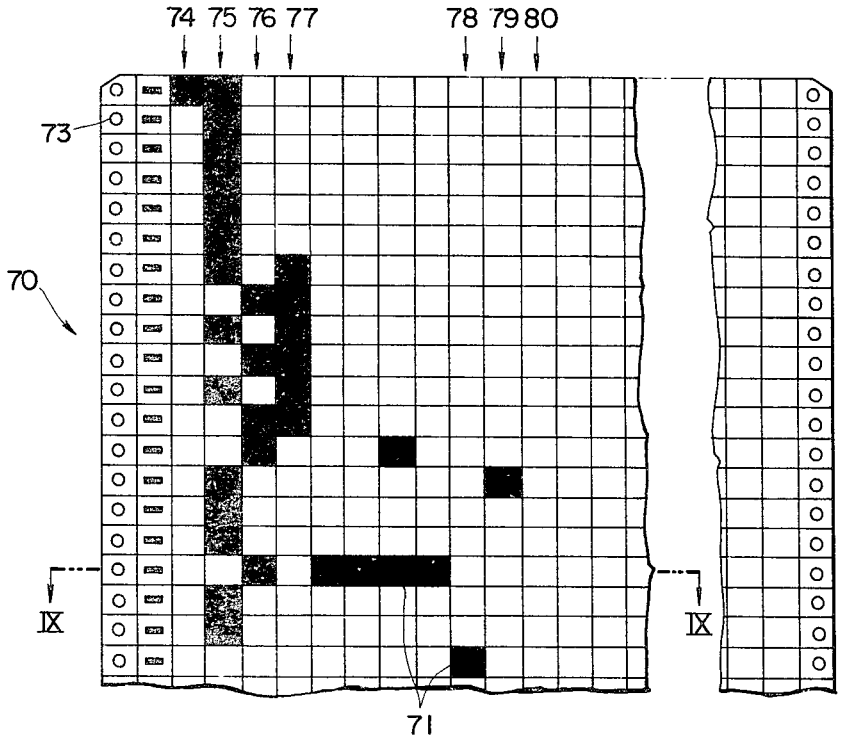
FIG. 8 is a partial plan view showing a program sheet.

FIGS. 8 and 9 are enlarged views showing the program sheet 70. A transparent recording sheet 72 has perforations 73 on both the sides thereof, and the central portion of the recording sheet 72 are longitudinally divided in several rows of regions. Each of these regions is designated as a region in which a mark for instructing whether or not the respective members of the knitting machines are actuated is formed. Moreover, the recording sheet 72 is laterally divided in a plurality of rows of regions at the same pitch as that of the perforations 73, and each region is designated as a resion in which there is formed a mark giving instructions with respect to the corresponding course at the knitting step. An original point mark indicating the start position is formed on the longitudinal region 74 only at a part of the first lateral row, that is, the first course. In other longitudinal region 75, there is formed, for example, a mark for normal rotation of the feed drum, and in the longitudinal region 76, there is formed a mark for reverse rotation of the feed drum and in the longitudinal region 77, there is formed a mark for jump of the feed drum. Further, in the regions 78, 79 and 80, there are formed a terminal point mark (return mark), a mark for actuation of the outer electromagnet and a mark for actuation of the inner electromagnet, respectively. Thus, the respective operations of the feed drum are instructed by marks formed in the respective longitudinal regions of the recording sheet 72 in the foregoing manner.

Marking of each region is performed by covering the predetermined square part of the transparent program sheet 72 by a non-transparent material 71. More specifically, a colored sheet having an adhesive applied on one surface thereof is cut into small piece having a size covering the predetermined part of the recording sheet 72, and the cut pieces as marks 71 are attached to the predetermined positions. Instead of this method using small pieces of a colored sheet, there may be adopted a method in which the predetermined parts of the program sheet 72 are coated with a non-transparent paint.

A protecting sheet 81 is piled on the so marked recording sheet 72 so that the marks 71 are prevented from falling in contact with other elements. The program sheet 70 and protecting sheet 81 may be bonded together at both the side edge portions thereof, or they may be merely overlapped to each other.

The perforations 73 on both the ends of the program sheet 70 having marks 71 formed at predetermined positions are engaged with the sprockets 44 of the feed drum 42 of the mark reader 40 of the knitting machine, whereby the program sheet 70 is introduced into the mark reader 40. At first, the program sheet 70 is set so that the original point mark 74 of the program sheet 70 is located at the reading zone 43. This operation is performed manually. The power source is then put on, and after confirmation of the presence of the original point mark 74 on the program sheet 70, the perforations are engaged with the sprockets 44 and the feed drum 42 is manually rotated in the clockwise direction in FIG. 6 to feed the program sheet 70 to the reading zone 43. After confirmation of passage of the original point mark 74 of the program sheet through the reading zone 43, the return switch is manually actuated to emit changeover instructions for reverse rotation to the motor driving mechanism. Thus, instructions for storage of the original point and start from the standard positon are reset, and the motor control mechanism is started by instructions for reverse rotation, whereby the motor is moved continuously to the point where the original point mark is present. When the original point mark 74 arrives at the front of the small hole 50 of the reading zone 43 to intercept the ray of the light emitting tube 47 from arriving at the phototransistor 48, the motor is stopped by step completion-indicating instructions.

By the foregoing operation, the program sheet 70 is stopped at the original position, and it is in the state where the knitting machine can be operated according to the schedule set by the program sheet 70. Then, the program sheet 70. Then, the program sheet 70 is normally rotated to operate the knitting machine. This process will now be described by reference to FIGS. 10*a* and 10*b*.

Figure 10A:
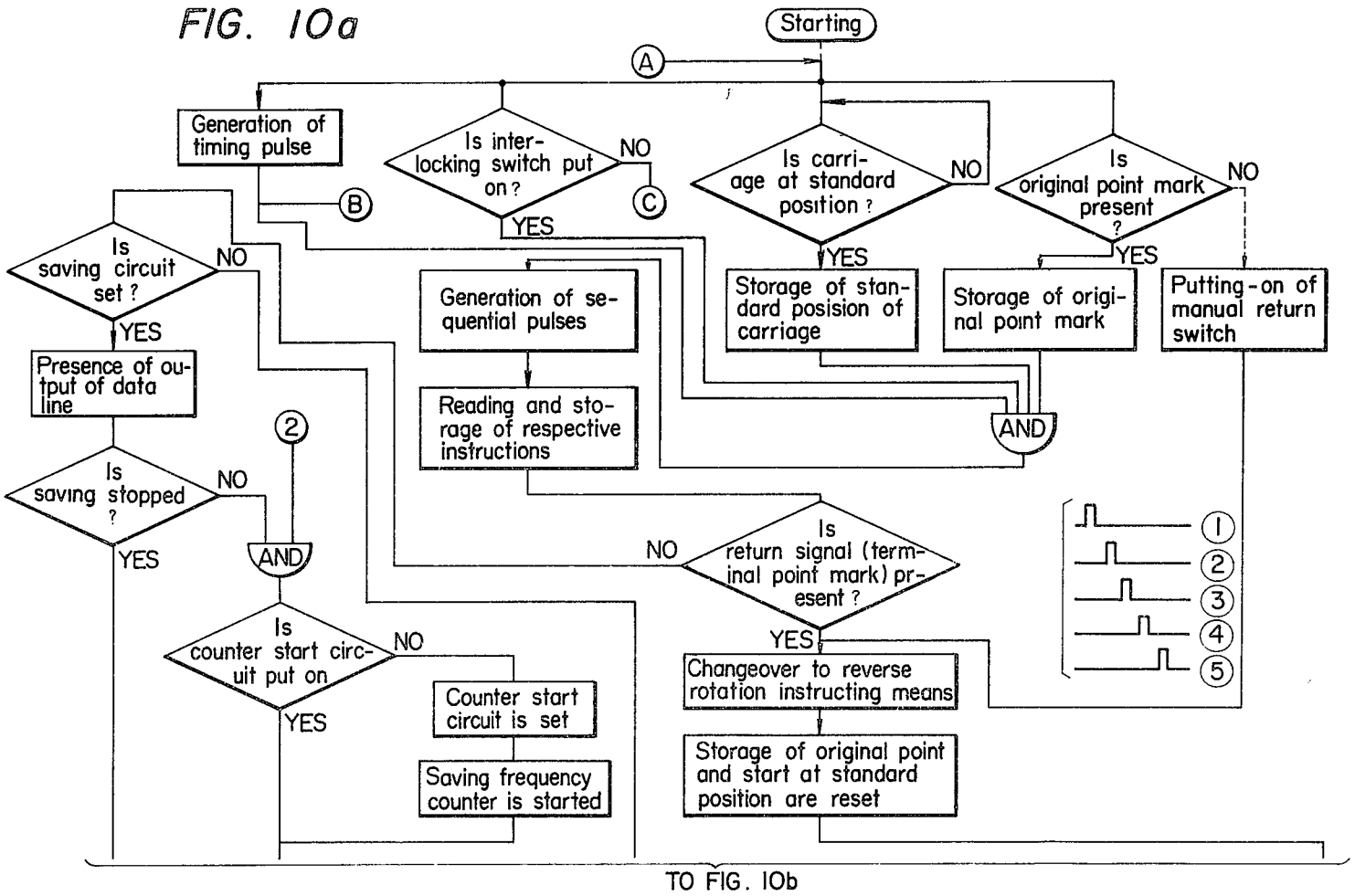
FIGS. 10*a* and 10*b* are a flow chart.
Figure 10B:
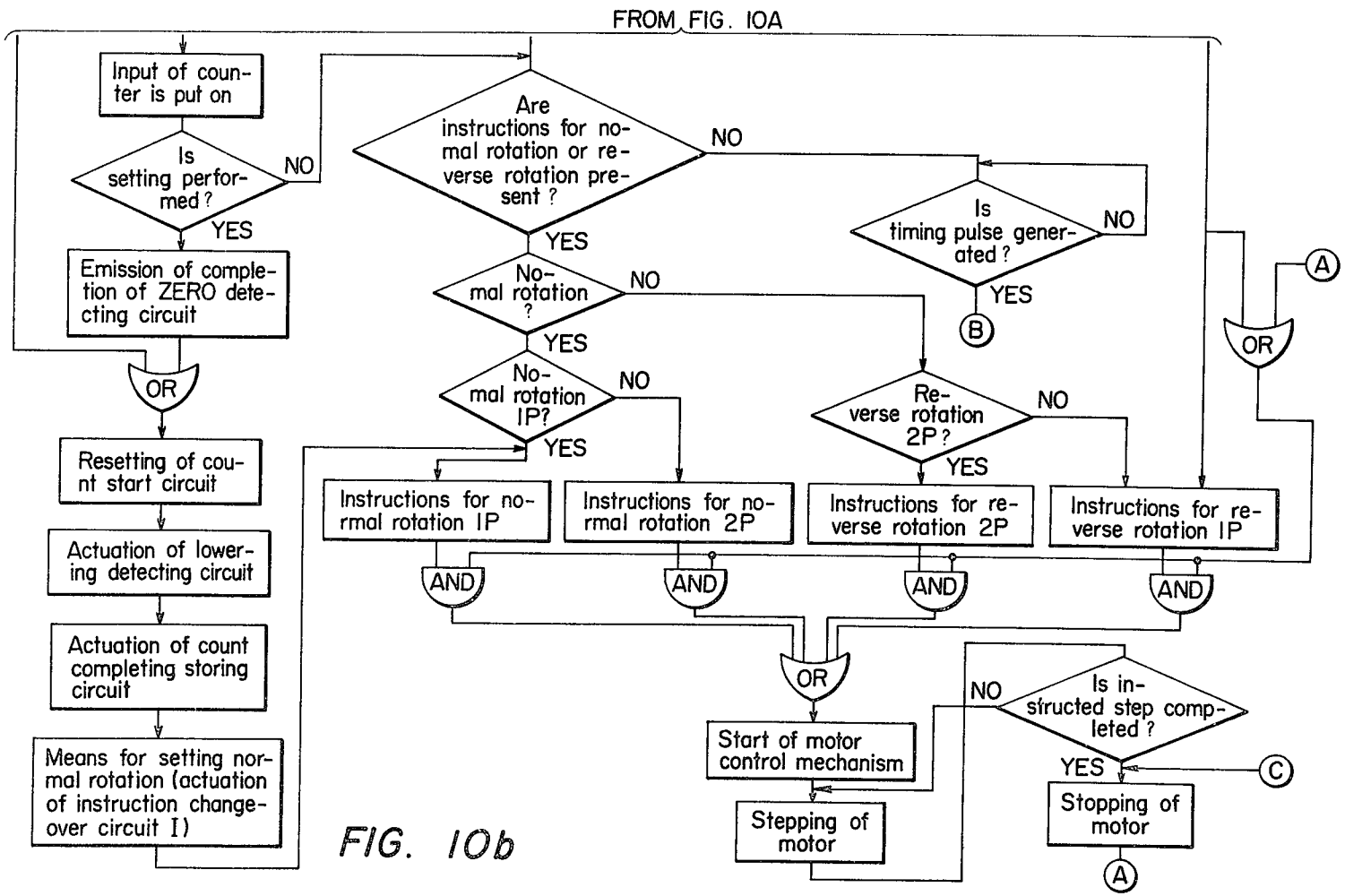

As shown in FIG. 10, at first, signals of "presence or absence of the original point" and "storage of the start mark" are emitted by the program sheet set at the original position, and in the second place, the "inter locking switch" is put on. Then, "a timing pulse is generated" with operation of the knitting machine. Finally, the location of the carriage at "the standard position" by the operation of the knitting machine and the standard position is stored. When all the signals of the foregoing four steps are simultaneously emitted, by normal rotation 1P instructions of "generation of sequential pulses'-'—"presence or absence of instructions for reversing rotation direction"—"normal rotation?"—"normal rotation 1P?"—"instructions for normal rotation 1P" and by sequential pulses of the start signal for starting the motor control mechanism, the rotation is continued until one feedback signal of "start of motor control mechanism" and "motor step" is detected, and when this signal is detected, a signal of "stop of motor" is emitted and the motor is stopped. Thus, the state is returned to the beginning portion of the flow chart of FIG. 10*a*. At this point, there is not present the original point mark any more. However, by a signal from the original point mark memory and timing pulses generated by the memory of the carriage stop position and the putting-on of the interlocking switch, the AND circuit shown in FIG. 10*a* is actuated again to perform the foregoing process steps.

While the program sheet 70 is repeatedly verified in the foregoing manner, instructions for operation of jacks 15 are emitted. The carriage is moved reciprocatively based on the instructions of the mark reader 40 which has verified marks on the carriage running instruction columns of the program sheet, and simultaneously, the presence of marks formed on electromagnet actuation columns 79 and 80 for operating needles according to a pattern to be formed on a knitted fabric is detected by the mark reader 50 through the phototransistors 48 and the inner electromagnet 24 or outer electromagnet 25 is actuated based on such detection signal.

Figure 2:
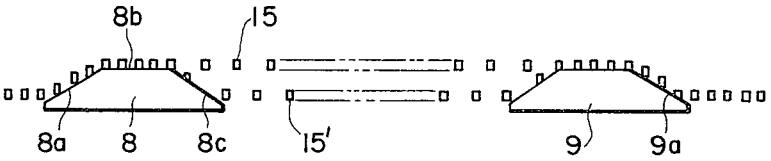
FIG. 2 is a front view, seen from the direction of the arrow in FIG. 5, of a jack and a jack operating cam, which illustrates the positional relationship between the jack and jack operating cam.
Figure 4:
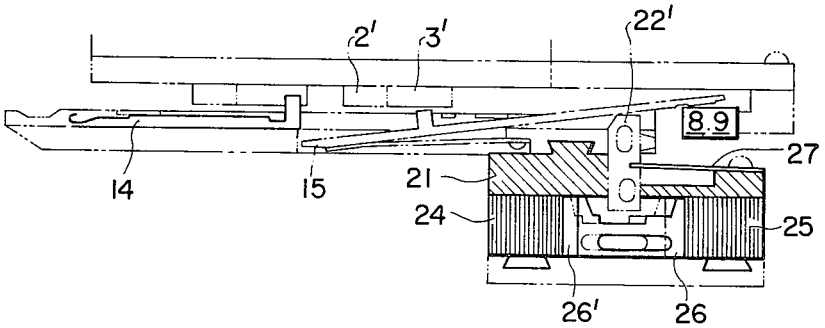

When the carriage is moved to the left, the jack 15 is raised by a left inclined portion 8-a of the jack operating cam 8 in FIG. 2, and this raising movement is stopped by an upper portion 8-b of the cam 8. More specifically, as shown in FIG. 4, the right end of the jack 15' is raised and hence, the left end of the jack 15' is hung down with the lower portion of the band 18 being as the fulcrum. With this movement, the upper selector 22 is raised to the position 22' indicated by a two-dot chain line by means of the plate spring 27, and the lower portion of the upper selector 22 is separated from the notched groove portion of the lower selector 26. All the jacks undergo the foregoing action with the movement of the carriage. While the upper selector 22 is raised, the jack 15 to be treated as the resting jack is selected. More specifically, if a mark is formed on the inner electromagnet actuation column 80 of the program sheet 70 so that the inner electromagnet 24 for the jack 15 to be rested among a plurality of jacks 15 will be actuated the inner electromagnet 24 for said jack 15 is actuated on detection of said mark to generate a magnetic force moving the lower selector 26 to the position 26' indicated by a two-dot chain line. However, the lower selector 26 contained in the groove where the non-actuated electromagnet is contained is retained at the original position. The above actuation of the electromagnet is performed while the end of the jack 15 is located on the top face 8-b of the jack operating cam 8.

Figure 5:
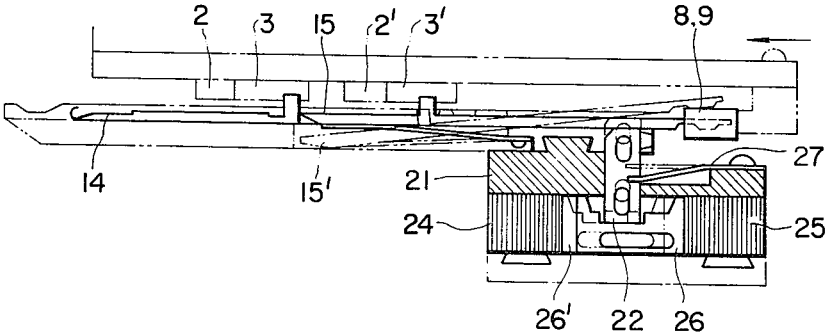

With further advance of the carriage, in the inner inclined portion 8-c of the jack operating cam 8, the right end of the jack 15' corresponding to the lower selector 26 not moved is caused to fall down along the inclination of the inclined portion 8-c, and simultaneously, also the upper selector 22 is brought down and returned to the original position inducated by a solid line in FIG. 5. The jack 15' corresponding to the moved lower selector 26' is not brought down because the lower portion of the upper selector 22 is not fitted in the notched groove portion of the lower selector 26', and this jack 15' is retained at the position indicated by a two-dot chain line in FIG. 5.

As will be apparent from the foregoing illustration, when the carriage is advanced, the butt of the jack 15 corresponding to the lower selector 26 not moved is located at such a position that it is operated by the wing cam 8', and therefore, needle selection and knitting are performed, and the jack 15 interlocked with the needle 14 is pressed down by the knitting cam 5 and is returned to the original position.

Then, the jack 15 which is kept in the operation state by the right jack operating cam 9 is similarly raised, and the upper selector 22 is separated from the lower selector 26.

Also the upper selector 22 falling in contact with the top face of the lower selector 26' is separated therefrom and is located at the position 22' shown in FIG. 4. At this point, the outer electromagnet 25 is actuated to generate a magnetic force to return the lower selector 26' from the shifted position to the original position indicated by the solid line.

By the foregoing operation, the right end of the jack 15' is brought down with advance of the carriage and the upper selector 22 is allowed to fall in engagement with the notched portion of the lower selector 26 and is returned to the original position.

By the foregoing operations, knitting of one course is completed. At the step of knitting the subsequent course, when the carriage is moved to the right, the right inclined portion 9*a* of the jack operating cam 9 is raised, and the same operations as described above are repeated.

In the foregoing embodiment, marks are formed on two columns of the program sheet 70, that is, lower and outer electromagnet actuation columns 80 and 79, for actuation of the inner electromagnet 24 and outer electromagnet 25. Instead of this arrangement, there may be adopted a modification in which marks are formed on one column and the two electromagnets are arranged so that one electromagnet is actuated on detection of the mark on this column and the other electromagnet is actuated after lapse of a certain delay time from the actuation of the first electromagnet.

What is claimed is:

1. An electromagnetic needle selecting apparatus for a flat knitting machine in which an upper selector moving in the verical direction together with a jack when the lower end of the jack comes out from a needle groove in a direction intersecting the needle groove at a right angle or comes into said needle groove is slidably supported by an electromagnet supporting plate, a pair of electromagnets are supported on both the sides of the lower portion of the upper selector by the electromagnet plate so that the lower portion of the upper selector is interposed between the electromagnets, a lower selector having on the top part thereof a stepped portion to be engaged with the upper selector is disposed so that the lower selector is allowed to freely slide between both the electromagnets by a selector receiver, and both the electromagnets are arranged so that when one electromagnet is actuated, the lower selector is attracted to said one electromagnet to engage the stepped portion of the lower selector with the lower end of the upper selector to prevent lowering of the upper selector and when the other electromagnet is actuated, the lower selector is attracted to said other electromagnet to release the engagement between the stepped portion of the lower selector and the lower end of the upper selector to bring down the upper selector, said automatic needle selecting apparatus being characterized in that said apparatus comprises a mark reader including a drum for stepwise feeding of a program sheet and being capable of emitting signals on verification of the presence of marks formed at predetermined positions of the program sheet by means of a photoelectric element and making operations corresponding to the verified marks, wherein columns for drum rotation marks for emittng signals of stepwise rotation of the drum of the mark reader and columns for jack operation marks for emitting signals of operation of a plurality of jacks are formed on the program sheet and the mark reader is provided with means for detecting marks formed on said columns, means for rotating the drum stepwise when a drum rotation mark is detected and means for actuating on detection of a jack operation mark the electromagnet corresponding to said detected jack.

2. An automatic control system for a flat knitting machine comprising a single program sheet which is not endless having marks formed on predetermined columns for verification by a mark reader including an original point mark and a return point mark at initial and terminal points of the program sheet, means for moving the program sheet reciprocally to place the original point mark and return point mark under a mark reader, and photoelectric means for detecting marks within the reading zone defined at the extremities between the original point mark and return point mark during movement of the program sheet between the original point mark and return point mark.

3. Structure as set forth in claim 2, and further including inner and outer electromagnets for receiving signals under control of the photoelectric mark reading means for selection of jacks whereby selection of needles can be electrically accomplished in a particularly short time.

4. Structure as set forth in claim 2, and further including marks formed on the program sheet for storing data on the program sheet.

5. A method of automatic electromagnet selection of needles for a flat knitting machine comprising the steps of forming marks in predetermined columns on a single program sheet, which program sheet is not endless, including an original point mark and a return point mark, moving the program sheet reciprocally between positions wherein the original point mark is under a mark reader and a position wherein the return point mark is under the mark reader and photoelectrically detecting the marks during movement of the single program sheet between the original point mark and the return point mark.

6. The method as set forth in claim 3, and further including selecting jacks in accordance with electric signals from the mark reader by actuating inner and outer electromagnets in accordance with electric signals from the mark reader whereby selection of needles is electrically easily accomplished in a short time.

7. The method as set forth in claims 5, and further including the step of forming marks on the program sheet to store data on the program sheet.

* * * * *